US006659813B2

(12) United States Patent
Sai

(10) Patent No.: US 6,659,813 B2
(45) Date of Patent: Dec. 9, 2003

(54) MALE CONTACT AND METHOD OF MANUFACTURING THE SAME

(75) Inventor: Noriaki Sai, Kanagawa (JP)

(73) Assignee: Tyco Electronics, AMP, K.K. (JP)

( * ) Notice: Subject to any disclaimer, the term of this patent is extended or adjusted under 35 U.S.C. 154(b) by 0 days.

(21) Appl. No.: 10/206,017

(22) Filed: Jul. 26, 2002

(65) Prior Publication Data

US 2003/0027464 A1 Feb. 6, 2003

(30) Foreign Application Priority Data

Aug. 3, 2001 (JP) ..... 2001-237004

(51) Int. Cl.[7] ..... H01R 13/02
(52) U.S. Cl. ..... 439/884
(58) Field of Search ..... 439/884–891, 439/692, 693, 697

(56) References Cited

U.S. PATENT DOCUMENTS 3,288,915 A 11/1966 Hatfield ..... 174/94
5,083,944 A * 1/1992 Pitts ..... 439/884
5,649,842 A * 7/1997 Ohsumi ..... 439/884
5,989,080 A * 11/1999 Tsuji et al. ..... 439/884
6,077,131 A * 6/2000 Fukuda et al. ..... 439/884
6,398,599 B1 * 6/2002 Irikura et al. ..... 439/884
6,402,575 B1 * 6/2002 Suzuki ..... 439/884

FOREIGN PATENT DOCUMENTS

JP 07192793 7/1995
JP 08162191 6/1996

* cited by examiner

*Primary Examiner*—Gary Paumen
(74) *Attorney, Agent, or Firm*—Barley Snyder

(57) ABSTRACT

A male contact having a male contact section formed by bending both sides of a metal plate inward and a method for manufacturing the same. The male contact section having a substantially rectangular cross-sectional shape and curved sections formed on four corners of the cross-sectional plane of the male contact section having a radius that is equal to or less than ⅓ of the thickness of the metal plate. The male contact makes it possible to obtain a sufficient area of contact with a mating female contact even in cases where the width of the male contact section formed by bending both sides of the metal plate inward is small.

4 Claims, 6 Drawing Sheets

MALE CONTACT AND METHOD OF MANUFACTURING THE SAME

BACKGROUND OF THE INVENTION

The invention relates to a male contact having a male contact section formed by bending both sides of a metal plate inward, and a method of manufacturing the same.

DESCRIPTION OF THE PRIOR ART

The contacts shown in FIG. 6 (see Japanese Patent Application Laid-Open No. H7-192793) and FIG. 7 (see Japanese Patent Application Laid-Open No. H8-162191) are known as conventional male contacts that have male contact sections formed by bending both sides of a metal plate inward.

Shown in FIG. 6(A), male contact 100 comprises a male contact section 101 that contacts a mating terminal (not shown), an electrical wire termination portion 102 connected to an electrical wire (not shown), and a securing portion 103 disposed between the male contact section 101 and the electrical wire termination portion 102 that is attached to a connector housing (not shown). Shown in FIG. 6(B), the male contact section 101 is formed by bending both sides of a stamped metal plate 104 so that joining faces 105 are positioned on an upper side in the approximate center with respect to the direction of width of the metal plate 104. The cross-sectional shape of the male contact section 101 is a substantially oval shape in the direction of width. Upper and lower surfaces of the male contact section 101 form substantially flat contact surfaces 106, 107, respectively, that contact a mating female contact (not shown). Curved sections 108 are formed on the four corners of the cross-sectional plane of the male contact section 101. The radius of the curved sections 108 is substantially equal to the thickness of the metal plate 104.

Shown in FIG. 7(A), male contact 200 comprises a male contact section 201 that contacts a mating terminal (not shown), an electrical wire termination portion 202 connected to an electrical wire (not shown), and a securing portion 203 disposed between the male contact section 201 and electrical wire termination portion 202 that is secured to a connector housing (not shown). Shown in FIG. 7(B), the male contact section 201 is formed by bending one side of a stamped metal plate 204 so that joining faces 205 are positioned at a side portion with respect to the direction of width of the metal plate 204. The cross-sectional shape of the male contact section 201 is a substantially oval shape in the direction of width. Upper and lower surfaces of the male contact section 201 form substantially flat contact surfaces 206, 207, respectively, that contact a mating female contact (not shown). Curved sections 208 are formed on the four corners of the cross-sectional plane of the male contact section 201. The curved sections 208 have a radius that is greater than the thickness of the metal plate 204.

Electrical connectors, such as the male contacts 100, 200 shown in FIGS. 6 and 7, are commonly used in industrial fields, such as the automotive field. In recent years there has been a demand for multi-pole connectors. As a result of this demand for multi-pole connectors, a need has arisen for contacts having male contact sections with a small width, for example 0.64 mm square posts.

When male contact sections are formed with a small width, by bending both sides of a stamped metal plate 104 or one side of a metal plate 204 in the same manner as the male contact sections 101, 201 of the male contacts 100, 200, an insufficient area of contact with the mating female contact (not shown) arises due to the fact that the curved sections 108, 208 formed on the four corners of the cross-sectional plane of the male contact sections 101, 201 have radii substantially equal to the thicknesses of the metal plates 104, 204. If a sufficient area of contact with the mating female contact (not shown) can not be obtained, the contact pressure between the contacts is unstable, resulting in unstable contact.

It is therefore desirable to provide a male contact having a sufficient area for contact with a mating female contact in cases where the width of the male contact section formed by bending both sides of a metal plate inward is small. It is further desirable to develop a method of manufacturing the same.

SUMMARY OF THE INVENTION

This and other objects of the present invention are solved by a contact part having an electrical wire termination portion, a metal contact part, and a securing portion disposed between the male contact section and the electrical wire termination portion. The male contact section is formed from a metal plate and has a rectangular cross-sectional shape. Curved sections are formed at corners of the cross-sectional shape that have a radius that is equal to or less than ⅓ of the thickness of the metal plate.

The male contact section is formed by bending both sides of the metal plate inward, and then shaping the cross-sectional shape into a substantially rectangular shape by forging so that the curved sections on the four corners of the cross-sectional plane have a radius that is equal to or less than ⅓ of the thickness of the metal plate.

BRIEF DESCRIPTION OF THE DRAWINGS

FIG. 4(A) shows the shapes of the dies and punches from a first step to a fourth step, and FIG. 4(B) shows the process of deformation of the male contact section formed by the respective steps from the first step to the fourth step;

FIG. 5(A) shows the shapes of the dies and punches from a fifth step to an eighth step, and FIG. 5(B) shows the process of deformation of the male contact section formed by the respective steps from the fifth step to the eighth step;

FIG. 6(A) shows a perspective view, and FIG. 6(B) shows a sectional view along line 6B—6B of FIG. 6(A); FIG. 7(A) shows a perspective view, and FIG. 7(B) shows a sectional view along line 7B—7B of FIG. 7(A).

DETAILED DESCRIPTION OF THE PREFERRED EMBODIMENTS

Figure 1:
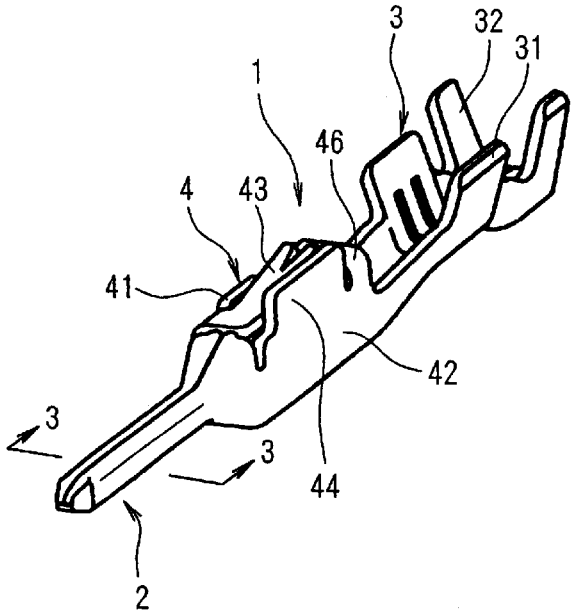
FIG. 1 is a perspective view of a first side of a male contact of the present invention.
Figure 2:
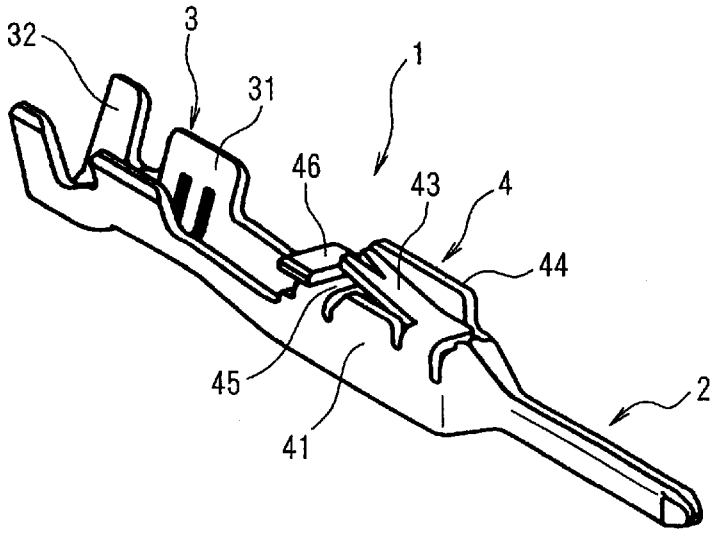
FIG. 2 is a perspective view of a second side of the male contact shown in FIG. 1.

FIGS. 1 and 2 show a male contact 1 having a male contact section 2, an electrical wire termination portion 3, and a securing portion 4. The male contact section 2 contacts a mating female contact (not shown). The electrical wire termination portion 3 is connected to an electrical wire (not shown). The securing portion 4 is secured to a connector housing (not shown) and disposed between the male contact section 2 and the electrical wire termination portion 3.

The individual components of the male contact 1 will now be described in greater detail. Shown in FIGS. 1 and 2, the electrical wire termination portion 3 has a wire barrel 31 and an insulation barrel 32. The wire barrel 31 is crimped to a core wire of the electrical wire (not shown). The insulation barrel 32 is crimped to a covering of the electrical wire (not shown).

Shown in FIGS. 1 and 2, the securing portion 4 has a contact lance 43. The contact lance 43 extends upward at an inclination toward the electrical wire termination portion 3 from a portion that is bent inward from an upper edge of a first side wall 41 of the securing portion 4. The contact lance 43 is secured to the connector housing wall (not shown) when the male contact 1 is received in a terminal accommodating hole of the connector housing (not shown). A lance protecting wall 44 extends upward from an upper edge of a second side wall 42 of the securing portion 4. The lance protecting wall 44 prevents the electrical wire (not shown) from becoming entangled with the contact lance 43 during assembly. Shown in FIG. 2, a lower-side top plate 45 extends inward from the upper edge of the first side wall 41 and closes off a lower portion of the contact lance 43. An upper-side top plate 46 extends inward from the upper edge of the second side wall 42 to superimpose the lower-side top plate 45. A double locking member (not shown) engages with end surfaces of the lower-side top plate 45 and upper-side top plate 46 on the side of the electrical wire termination portion 3 when the male contact 1 is accommodated in the connector housing (not shown). The upper-side top plate 46 is installed because a sufficient margin for engagement with the double locking member can not be ensured by the lower-side top plate 45 alone.

Figure 3:
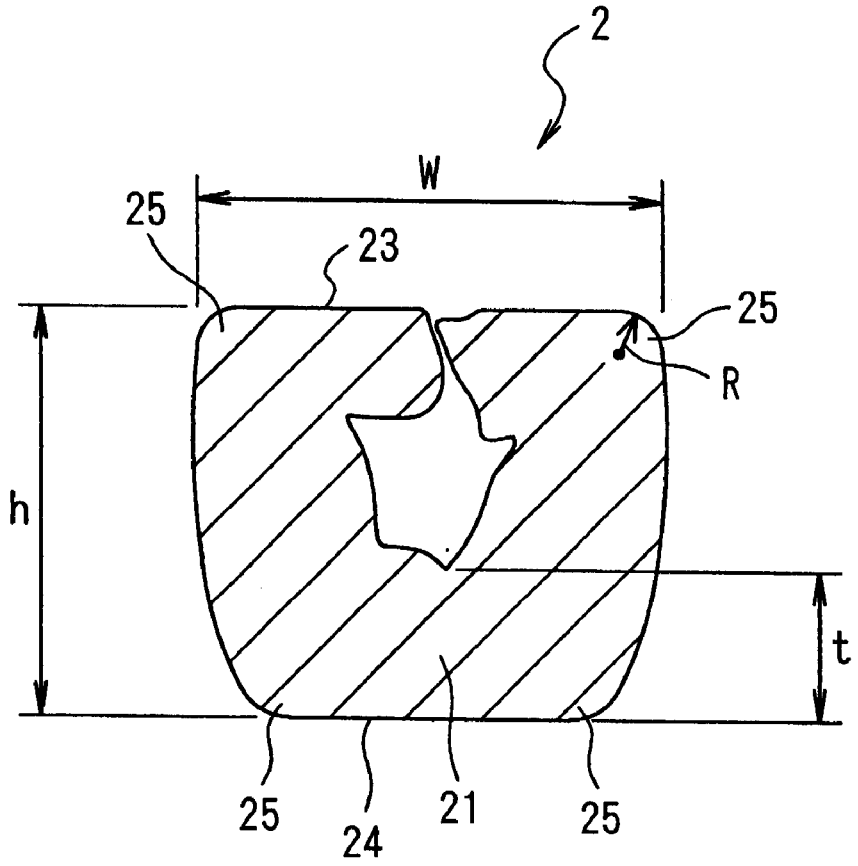
FIG. 3 is an enlarged sectional view along line 3—3 of FIG. 1.
Figure 6:
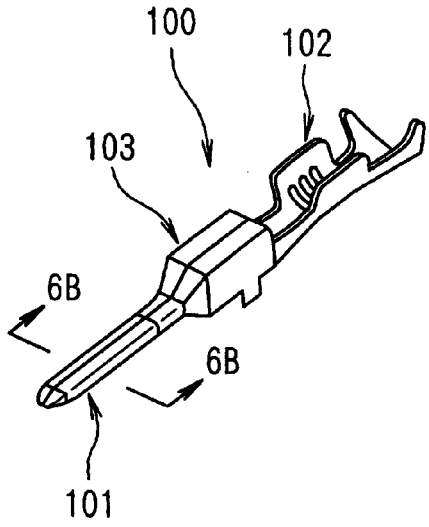
FIG. 6 (A) Prior Art
FIG. 6 shows a first example of a conventional male contact.
Figure 6:
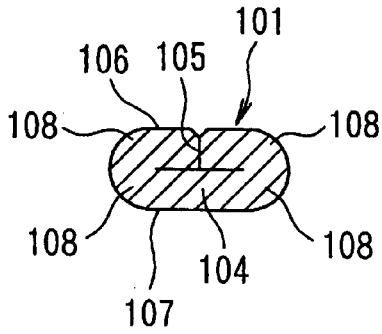
FIG. 6 (B) Prior Art
Figure 7:
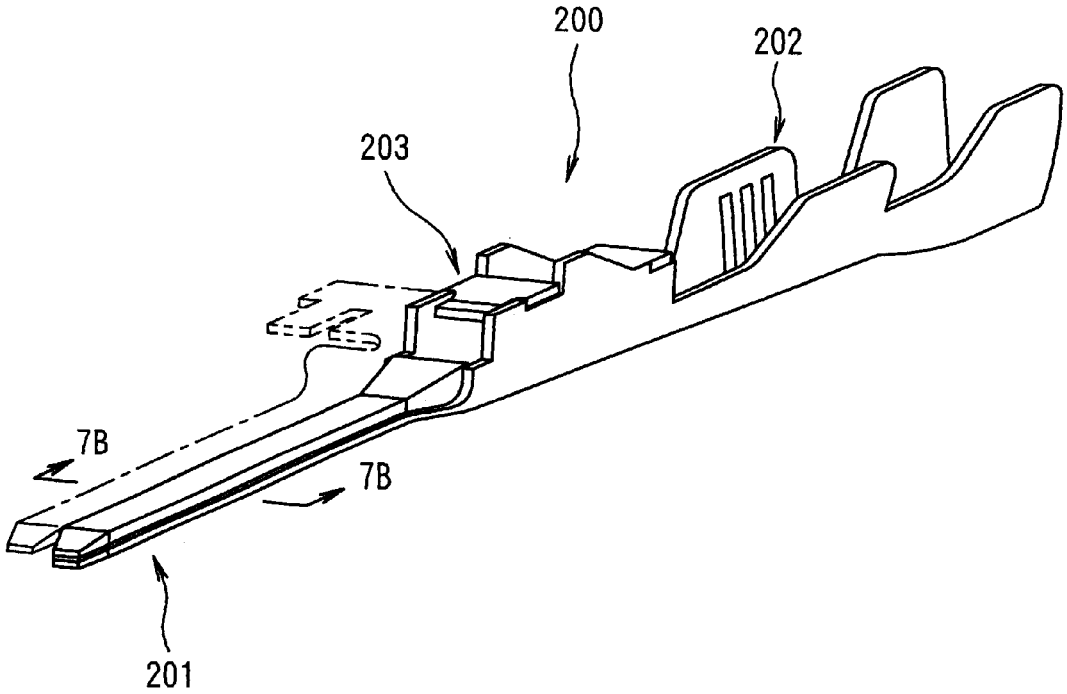
FIG. 7 (A) Prior Art
FIG. 7 shows a second example of a conventional male contact.
Figure 7:
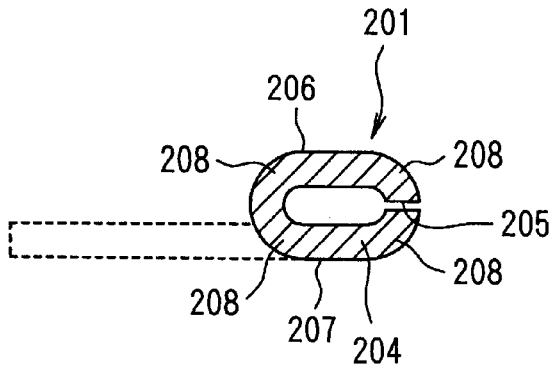
FIG. 7 (B) Prior Art

FIG. 3 shows a sectional view of the male contact section 2. The male contact section 2 is formed by bending both sides of a stamped metal plate 21 inward and then shaping the cross-sectional shape into a substantially rectangular shape by forging. The male contact 2 is formed so that the curved sections 25 on the four corners of the cross-sectional plane have a radius R that is equal to or less than ⅓ of the thickness t of the metal plate 21. In the cross section of the male contact section 2, the width w of the male contact section 2 is slightly greater than the thickness h, however, the cross-sectional shape is extremely close to square. As a result, the width w of the male contact section 2 is smaller than the widths of the conventional tab type male contact sections 101, 201 shown in FIGS. 6 and 7. The joining faces 22 on both sides of the metal plate 21 are positioned on the upper side in the approximate center with respect to the direction of width of the metal plate 21. The upper and lower surfaces of the male contact section 2 form substantially flat contact surfaces 23, 24, respectively, that contact the mating female contact (not shown).

Figure 4:
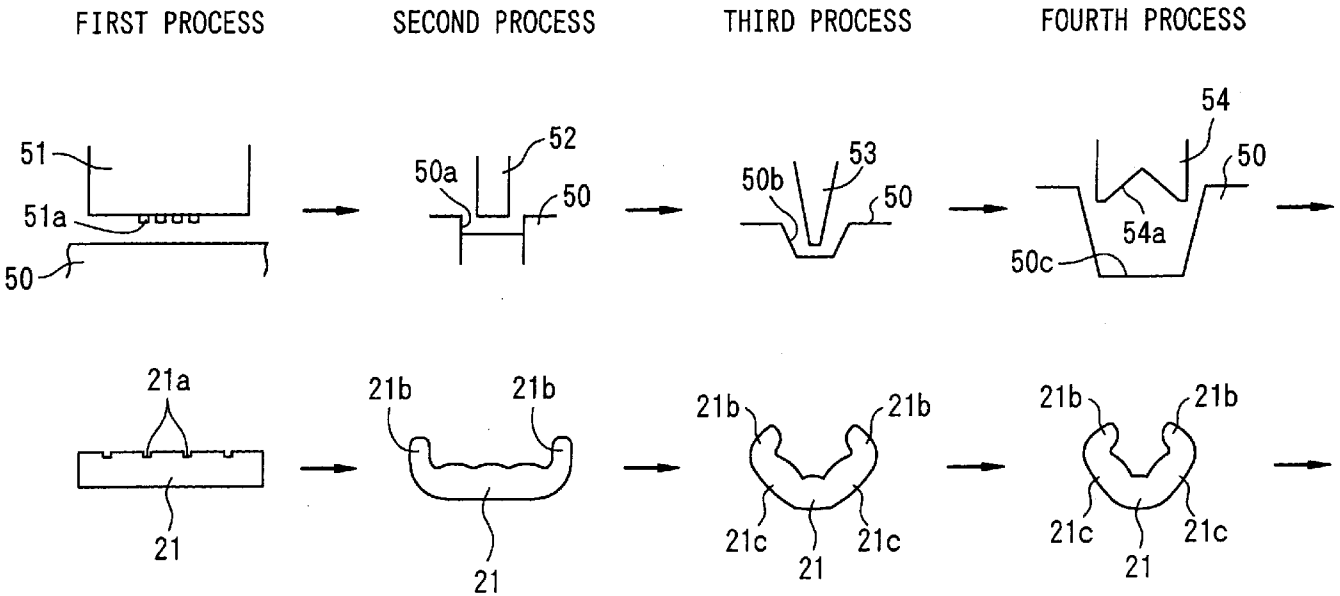
FIG. 4 shows a method of manufacture of the male contact section.
Figure 5:
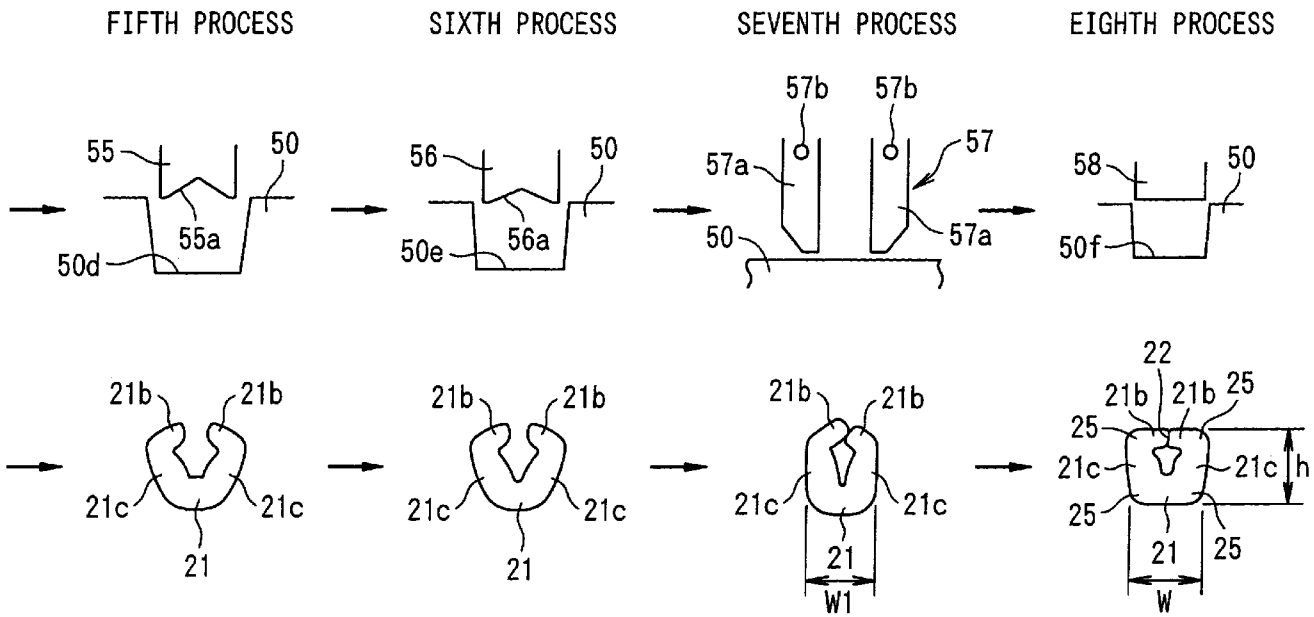
FIG. 5 shows the method of manufacture of the male contact section in FIG. 4.

A method used to manufacture the male contact section 2 will now be described in greater detail with reference to FIGS. 4 and 5. FIG. 4 illustrates the first through fourth steps used to manufacture the male contact section 2, and FIG. 5 illustrates the fifth through eighth steps used to manufacture the male contact section 2. The second through seventh steps represent bending processes, and the eighth step represents a forging process.

Shown in FIG. 4, in a first step a stamped metal plate 21 is placed on a die 50 having a flat surface. The metal plate 21 is pressed from above by a punch 51 having a plurality of projecting ribs 51*a* on a bottom surface to form a plurality of linear recessed parts 21*a* in an upper surface of the metal plate 21.

In a second step, the metal plate 21 is placed on a recessed part 50*a* of a die 50. The metal plate 21 is pressed from above by a punch 52 having a width smaller than the width of the recessed part 50*a*. The punch 52 has a tip end having a flat surface so that a pair of first bent parts 21*b* that extend upward are formed on both edges of the metal plate 21.

In a third step, the metal plate 21 is placed on a recessed part 50*b* formed on a surface of a die 50. The recessed part 50*b* has relatively gradual inclined surfaces formed on both sides. The metal plate 21 is pressed from above by a punch 53 having inclined surfaces on both sides and a tip end having a flat surface, so that the areas between the metal plate 21 and the pair of first bent parts 21*b* located on both edges of the metal plate 21 are bent slightly upward to form a pair of second bent parts 21*c*.

In a fourth step, the metal plate 21 is placed on a recessed part 50*c* formed on a surface of a die 50. The recessed part 50*c* has inclined surfaces formed on both sides that are somewhat steeper and deeper than the inclined surfaces of the recessed part 50*b*. The first bent parts 21*b* of the metal plate 21 are pressed from above by a punch 54 having a V-shaped recessed part 54*a* formed on a tip end, so that the pair of second bent parts 21*c* are caused to bend toward each other.

Shown in FIG. 5, in a fifth step the metal plate 21 is placed on a recessed part 50*d* formed on a surface of a die 50. The recessed part 50*d* has inclined surfaces that are somewhat steeper than the inclined surfaces of the recessed part 50*c* and has the same depth as the recessed part 50*c*. The first bent parts 21*b* of the metal plate 21 are pressed from above by a punch 55 having a V-shaped recessed part 55*a* formed in a tip end so that the inclination of both side surfaces is somewhat more gradual than in the V-shaped recessed part 54*a* to bend the pair of second bent parts 21*c* so that the pair of second bent parts 21*c* are caused to bend closer toward each other.

In a sixth step, the metal plate 21 is placed on a recessed part 50*e* formed on a surface of a die 50. The recessed part 50*e* has inclined surfaces formed on both sides that are somewhat steeper than the inclined surfaces of the recessed part 50*d*, and has the same depth as the recessed part 50*d*. The first bent parts 21*b* of the metal plate 21 are pressed from above by a punch 56 having a V-shaped recessed part 56*a* formed on a tip end and side surfaces having an inclination somewhat more gradual than in the V-shaped recessed part 55*a*, so that the pair of second bent parts 21*c* are caused to bend closer toward each other.

In a seventh step, the metal plate 21 is placed on a die 50 having a flat surface. The side surfaces of the pair of second bent parts 21*c* are pressed by a punch 57 having a pair of pressing plates 57*a* that can pivot about the respective axes 57*b* until the total width wl formed by the side surfaces is substantially equal to the width w of the male contact section 2 following working.

In an eighth step, the metal plate 21 is placed inside a recessed part 50*f* formed on a top surface of a die 50. The recessed part 50*f* has vertical surfaces on both sides and a width slightly greater than w1. The pair of first bent parts 21*b* are struck from above by a punch 58 with a tip end having a flat surface and a width slightly smaller than the width of the recessed part 50*f*, so that the male contact section 2 is formed with a substantially rectangular cross-sectional shape.

Shown in FIG. 3, the male contact section 2 manufactured as described herein has a substantially rectangular cross-sectional shape in which curved sections 25 formed on the four corners of the cross-sectional plane of the male contact section 2 have a radius R that is equal to or less than ⅓ of the thickness t of the metal plate 21. Accordingly, even in cases where the width w of the male contact section 2 is small, the contact surfaces 23, 24 that contact the mating female contact (not shown) can be made broad, so that a sufficient area of contact with the mating female contact (not shown) can be obtained.

Furthermore, in the method of manufacturing the male contact of the present invention, the male contact section is formed by bending both sides of a metal plate inward, and then shaping the cross-sectional shape into a substantially rectangular shape by forging so that the curved sections on the four corners of the cross-sectional plane have a radius that is equal to or less than ⅓ of the thickness of the metal plate. Accordingly, a male contact which makes it possible to obtain a sufficient area of contact with the mating female contact can easily be manufactured even in cases where the width of the male contact section formed by bending both sides of a metal plate inward is small.

The foregoing illustrates some of the possibilities for practising the invention. Many other embodiments are possible within the scope and spirit of the invention. It is, therefore, intended that the foregoing description be regarded as illustrative rather than limiting, and that the scope of the invention is given by the appended claims together with their full range of equivalents.

I claim:

1. A male contact comprising:

an electrical wire termination portion;

a male contact section formed from a metal plate and having a rectangular cross-sectional shape, an upper surface, a lower surface and curved sections formed at corners between the upper and lower surfaces; and a securing portion disposed between the male contact section and the electrical wire termination portion, wherein the curved sections have a radius that is equal to or less than ⅓ of the thickness of the metal plate.

2. The male contact of claim 1, wherein the metal plate includes a first joining face positioned proximate a second joining face.

3. The male contact of claim 2, wherein the first and second joining faces are positioned on an upper surface of the male contact section.

4. The male contact of claim 3, wherein the first and second joining faces are centered with respect to the direction of width on the upper surface.

* * * * *